US005289619A

United States Patent [19]

Pileggi

[11] Patent Number: 5,289,619

[45] Date of Patent: Mar. 1, 1994

[54] APPARATUS FOR BINDING ITEMS AND METHOD OF USING SAME

[76] Inventor: Joseph Pileggi, 1465 Broad St., Dresher, Pa. 19025

[21] Appl. No.: 915,017

[22] Filed: Jul. 16, 1992

Related U.S. Application Data

[63] Continuation-in-part of Ser. No. 861,105, Mar. 31, 1992.

[51] Int. Cl.[5] ..... A44B 18/00

[52] U.S. Cl. ..... 24/306; 24/17 AP; 24/442

[58] Field of Search ..... 24/306, 442, 31 V, 17 AP, 24/16 R; 128/DIG. 15; 248/74.3

[56] References Cited

U.S. PATENT DOCUMENTS

| | | | |
|---|---|---|---|
| D. 270,779 | 10/1983 | Steinberg . | |
| 2,361,506 | 10/1944 | Smith | 24/17 AP |
| 3,241,881 | 3/1966 | Carnahan et al. | 24/306 |
| 3,279,008 | 10/1966 | Wallach . | |
| 3,383,738 | 5/1968 | Fox . | |
| 3,640,273 | 2/1972 | Ray | 24/306 |
| 3,679,530 | 7/1972 | Perina . | |
| 3,841,648 | 10/1974 | Meyer . | |
| 3,893,725 | 7/1975 | Coulter . | |
| 3,936,980 | 5/1960 | Rapata | 248/74.3 |
| 4,358,081 | 11/1982 | Notoya | 248/74.3 |
| 4,466,159 | 8/1984 | Burrage | 24/17 AP |
| 4,530,350 | 7/1985 | Brown et al. | 128/DIG. 15 |
| 4,862,563 | 9/1989 | Flynn | 24/306 |
| 4,878,274 | 11/1989 | Patricy . | |
| 5,008,987 | 4/1991 | Armour, II | 24/306 |
| 5,012,558 | 5/1991 | Willoughby | 24/17 AP |
| 5,076,288 | 12/1991 | Millard et al. | 24/443 |
| 5,100,393 | 3/1992 | Johnson | 24/306 |
| 5,142,743 | 9/1992 | Hahn | 24/442 |
| 5,214,874 | 6/1993 | Faulkner | 24/442 |

FOREIGN PATENT DOCUMENTS

| | | | |
|---|---|---|---|
| 0698696 | 10/1953 | United Kingdom | 24/17 AP |
| 1161406 | 8/1969 | United Kingdom . | |

*Primary Examiner*—Victor N. Sakran
*Attorney, Agent, or Firm*—John W. Logan, Jr.

[57] ABSTRACT

The present invention provides an improved utility strap and method for using same for general binding purposes. The strap of the present invention provides a strip of material which includes hook-and-loop attachment means on both sides of one end of the strap, and complementary hook-and-loop material on both interior faces of a Y-shaped element anchored to the opposite end of the strap. Attachment is achieved by securing the first end of the strap within the Y-shaped element. The present invention provides all the benefits of ease of use found with conventional hook-and-loop binding devices, but is far more secure and durable.

7 Claims, 5 Drawing Sheets

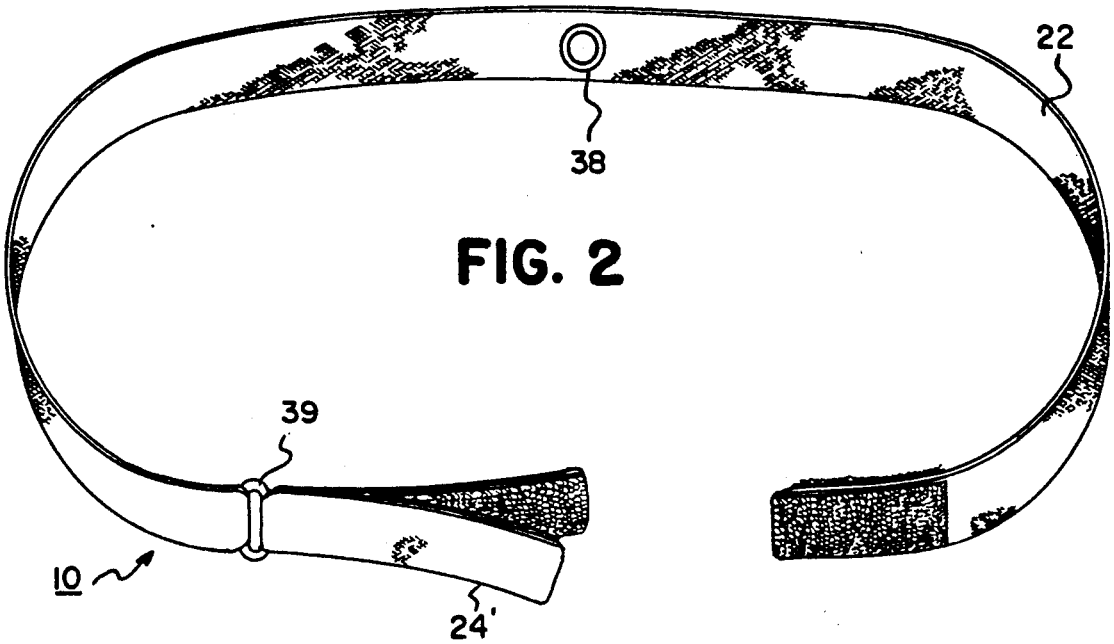
FIG. 2
FIG. 6
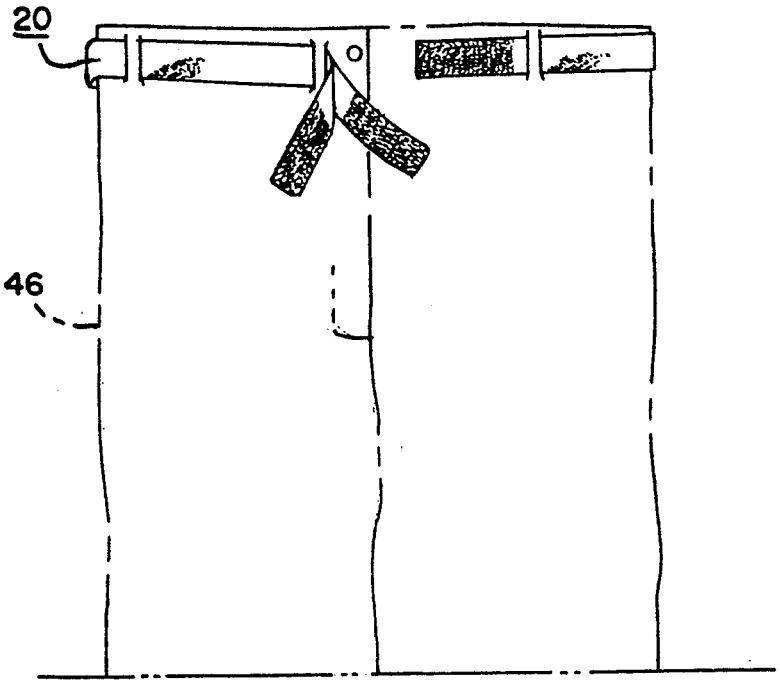

APPARATUS FOR BINDING ITEMS AND METHOD OF USING SAME

The present application is a continuation-in-part of copending U.S. patent application Ser. No. 861,105, filed Mar. 31, 1992.

BACKGROUND OF THE INVENTION

1. Field of the Invention

The present invention relates to general purpose utility bands used to bind a wide variety of items, including serving as a belt to secure clothing. More specifically, the present invention provides an improved fastening device for such binding devices.

2. Description of the Prior Art

Various devices for binding and holding items together have been used for many years. These binding devices, such as elastic bands, string, ropes, straps and belts hold items together for convenience of handling and maintaining order.

One of the major areas for concern with respect to such binding devices has been to find an easy-to-use yet reliable fastening means to secure such devices together. Although buckles and ties continue to be used due to their simplicity and general utility, these devices are deficient in numerous respects. First, conventional buckles, such as a standard clothing belt buckle, normally are somewhat difficult to fasten and unfasten and often have limited adjustability. For instance, a standard belt buckle (i.e. employing a buckle frame, multiple punch holes in the belt, a tongue passing through one of the punch holes and securing against the frame, and a keeper to secure the loose tip of the belt), is known to have limited adjustability (with punch holes usually positioned about 1 inch apart) and as requiring additional slack beyond the desired fastened length to secure the tongue in the punch hole. Further, if the belt is too long, the loose tip of the belt must be secured in some manner to avoid interfering with the wearer. Numerous other belt designs have been suggested to avoid some or all of these problems, but none are considered entirely successful.

One product which has been widely employed as a fastening means is hook-and-loop fabric, such as that sold under the trademark VELCRO. Although hook-and-loop is being used for many fastening and binding projects, it has a number of drawbacks when applied to a clothing belt or in conjunction with other general utility binding bands.

For example, applicant is aware of at least one instance where hook-and-loop material was attached to a clothing belt—with a long length of hook material applied to one end of the belt, and a long length of complementary loop material applied to the opposite face of the belt at the opposite end. In this instance the limited shear strength of the hook-and-loop material was insufficient to retain the belt adequately in a closed position. Moreover, as is known, with heavy use (and especially with use involving substantial shear) the hook-and-loop material rapidly fatigues and no longer maintains its fastening strength. Accordingly, the operation and appearance of this belt steadily deteriorated over time.

Other examples of use of hook-and-loop fasteners for general utility projects include U.S. Pat. Nos. 3,279,008 issued Oct. 18, 1966, to Wallach (for a ski binding strap); 3,383,738 issued May 21, 1968, to Fox et al. (for a chair binding strap); 3,679,530 issued Jul. 25, 1972, to Perina (for general attachment between non-planar surfaces); 3,841,648 issued Oct. 15, 1974, to Meyer (for a ski binding strap); 3,893,725 issued Jul. 8, 1975, to Coulter et al. (for a container latching device); D720,779 issued Oct. 4, 1983, to Steinberg (for a shoelace bow knot retainer); 4,878,274 issued Nov. 7, 1989, to Patricy (for general securement system, such as for skis); and British Patent 1,161,406 issued Aug. 13, 1969, to Smith (for a general fastening means). In each of these examples, the hook-and-loop systems disclosed comprise a single layer of hook material on one strap face and another single layer of loop material on another strap face. Although each of these systems may work adequately well for their stated purposes, each has the same problems with wear and shear which was discussed above with regard to the clothing belt design.

In light of the foregoing, it is a primary object of the present invention to create a binding device which has the convenience of hook-and-loop fasteners, but is more reliable and less prone to wear than existing fastening devices.

It is another object of the present invention to provide a binding device that is easy to install and remove without damaging the bound item.

It is a further object of the present invention to provide a binding device employing hook-and-loop fasteners which is more resistant to lateral shear forces than existing hook-and-loop fasteners.

It is another object of the present invention to provide a binding device which can be employed as a clothing belt with a reliable and aesthetically appealing method of fastening it to itself.

These and other objects of the present invention will become evident from review of the following specification.

SUMMARY OF THE INVENTION

The present invention provides a general purpose binding device which employs a unique hook-and-loop fastener which is easy to use and avoids many of the wear and reliability problems inherent in existing hook-and-loop binding devices.

In its simplest form, the present invention provides an elongated strip of material with hook-and-loop attachment means on each end. The binding means includes a Y-shaped end on one section of the strip which is adapted to surround and bind to complementary attachment means on the opposite end of the strip. The strip is wrapped entirely around the item to be bound such that one end of the strip is placed between the interior faces of the Y-shaped end and then pressing the hook and loop fastener section together, forming a secure connection and creating a continuous secure wrapping around the item. It has been found that this provides a vastly improved binding device which is extremely secure.

Further embodiments of the present invention provide various means for providing easy adjustability for the strap. In one such embodiment, an opening is provided within the Y-shaped end through which excess length of the strap may be safely secured. Another embodiment of the present invention provides an adjustable slide clamp and ring intermediate the ends of the strip to change the length of the strap easily.

The strap of the present invention is far more secure and provides far greater utility than existing hook-and-loop fastening straps. The present invention has a wide range of possible applications, including serving as a belt to secure clothing, binding any form of rolled or bundled material, and serving as a hanging or anchoring means.

DESCRIPTION OF THE DRAWINGS

The operation of the present invention should become apparent from the following description when considered in conjunction with the accompanying drawings, in which:

FIG. 2 is a perspective view of a second embodiment of the binding device of the present invention, including means to hook the binding device to another object.

FIG. 6 is a perspective view of an embodiment of the present invention being used as a clothing belt, shown attached to a pair of trousers.

DETAILED DESCRIPTION OF THE INVENTION

The present invention provides an improved apparatus and method for general binding of virtually any item which would normally be done by string, rope, straps, belts, bungee cords, etc., such as rolled or bundled material, carpet, and stationery. The present invention also has numerous other uses, including securing objects to be hung, securing objects in a marine environment, and serving as a belt to hold up clothing (e.g. a pair of trousers or a skirt).

Figure 1:
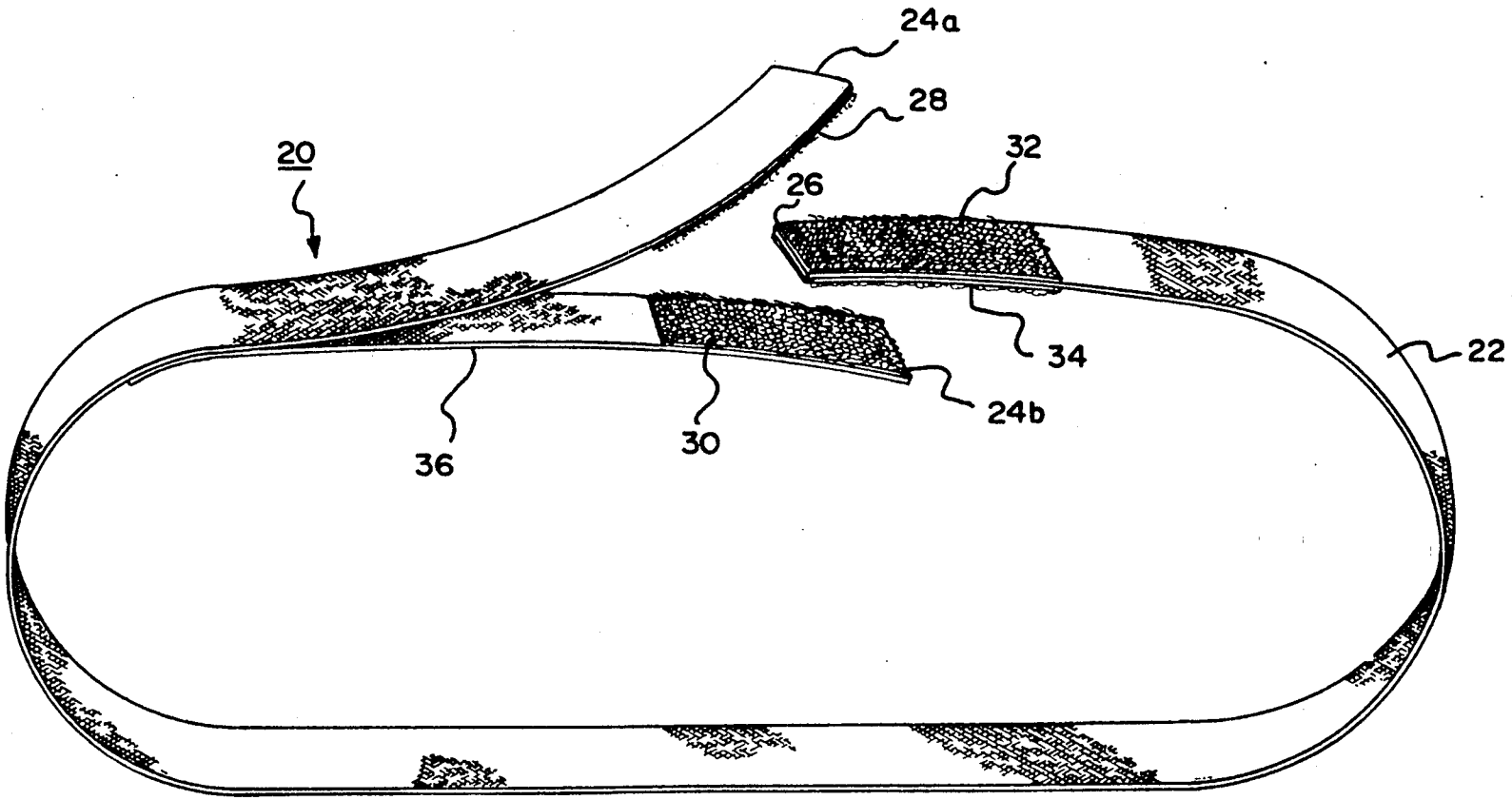
FIG. 1 is a perspective view of one embodiment of the binding device of the present invention.

As shown in FIG. 1, in its simplest form the present invention comprises a strap or band 20 which includes a strip of material 22 and with strip ends 24 and 26. The first strip end 24 is divided to form a Y-shaped unit, presenting two ends 24*a*, 24*b*. Attached to each of the ends 24, 26 is hook-and-loop attachment means, such as that which is sold under the tradename VELCRO.

Attached to interior faces 28, 30 of the "Y" on each of ends 24*a*, 24*b* is one portion of the hook-and-loop fastener (i.e. either a hook or loop portion). End 26 comprises a single strip including a complementary portion of hook or loop fastener on both its faces 32, 34. By placing end 26 between each of the faces of the Y and closing each of the faces 28, 30 around it, an extremely secure attachment is achieved. The ends 24, 26 are easily separated from each other by peeling back each face 28, 30 from the corresponding end 26. The advantage of this connection is that the two sided connection can resist a greater amount of shear in a direction co-planar of the fastening sections than a strip having only a single sided attachment means.

The double strip ends 24*a*, 24*b* of the "Y" may be created through any suitable means, including attaching a separate segment to strip 22 along its length (e.g. by gluing, sewing, or heat welding) at joint 36, attaching a separate segment to strip 22 at its end (i.e. in a T-shape), or by molding or forming the strip 22 to include the joint in its original construction. A very strong connection may be achieved by attaching a separate segment to the strip 22 along an extended length of the strip intermediate its ends (e.g. a length equal to or greater than the length of the face 28 or 30 is affixed to the strip 22).

Depending upon application, the strip 22 may be constructed from any suitable material, such as metal, leather, fabric, nylon, rubber, plastic, or any similar material. For example, to bind stationery items, a cloth-/elastic composite is preferred, such as a polyester elastic (e.g. 62% polyester, 38% rubber) manufactured by Simplicity Pentapco of Franklin, Va. The strip 22 can be manufactured in any desired length, the length being dictated by the size of the items to be bound.

The width of the strip 22 is also dictated by the particular applications desired. The width is a function of the anticipated breaking strength required, the nature of the material to be bound, and adequate area to retain the attachment means together.

For general utility, the preferred strip 22 comprises a length of 5" to 12" to 24" or longer, with a width of ¼" to 2". For a strip of approximately 12" length and a width of ¼", it is preferred that the area of the strip where the attachment means is attached should comprise a width of approximately ¾" to provide a more secure attachment.

As is known, as a clothing belt, the length of the strip could range from 15", for a child, to 50" or more. As is also known, the width of the belt is dictated more by fashion than operation and may be as narrow or wide as present style may require, with a width of at least 1" being preferred for operation.

Also depending upon application, the hook-and-loop attachment means may be affixed to the strip by any known method, including sewing, glue, rivets, etc.

FIG. 2 shows another embodiment of the present invention, wherein band 20 provides an opening 38 in the center of the strip 22 and intermediate its ends. This opening 38 can be used to attach to any separate mounting means, such as a nail, hook, rope, or tie, to attach the strap of the present invention to a wall or other object, or to mount a guide line, clothes line or similar device. As is shown, the opening 38 may be reinforced with a grommet or other known device to protect the strip 22 from tearing or other damage. FIG. 2 also illustrates a further means for applying the Y-shape end 24'. In this embodiment, the end 24' is attached to the strip 22 by an oval ring 39, with both the end 24' and the strip 22 attached to the ring 39 through sewing or similar means.

It should be understood that the precise length of the present invention may be adjusted by merely relocating the position of end 26 within the length of the Y-shaped end 24. By enlarging the size of the Y-shaped end 24, a fairly large degree of adjustability can be achieved using this adjustment method. Additionally, as is explained below, the present invention readily lends itself to other methods of providing even greater degree of adjustability.

Figure 3:
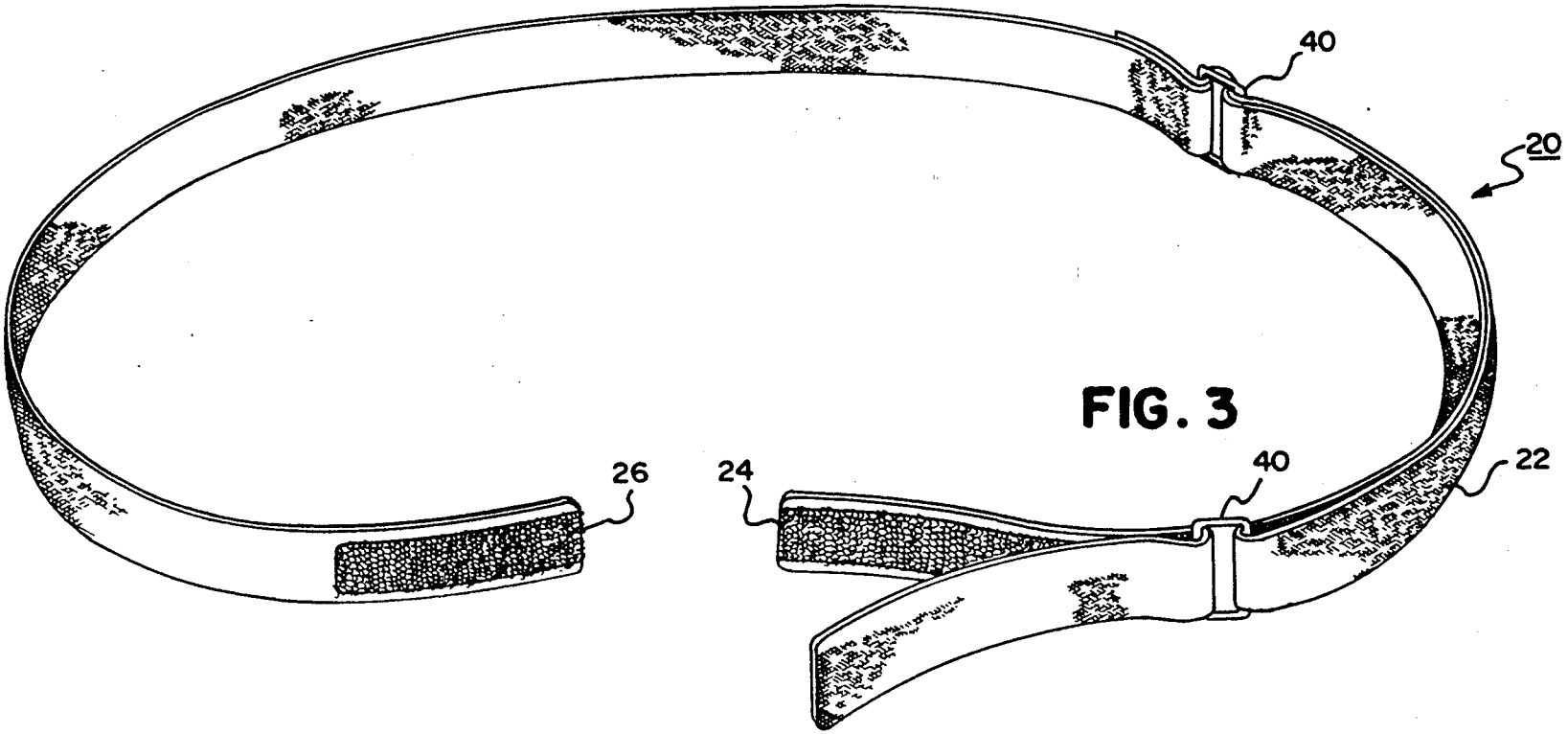
FIG. 3 is a perspective of view of a third embodiment of the binding device of the present invention, including means to adjust the operative length of the strap.
Figure 4:
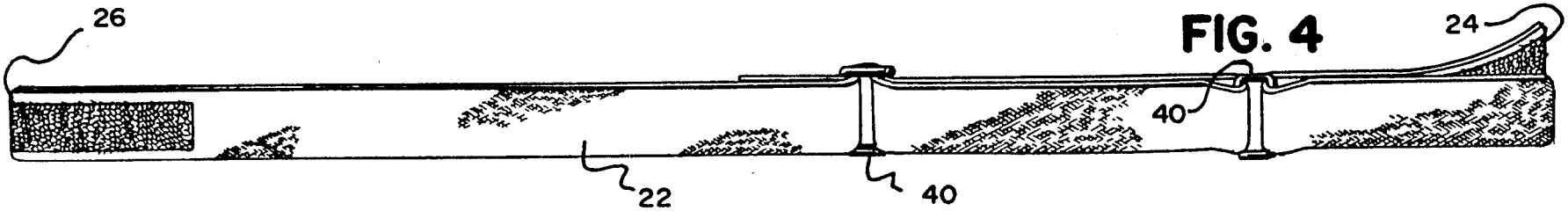
FIG. 4 is a plan view of the embodiment of the present invention illustrated in FIG. 3.

A further embodiment of the present invention is shown in FIGS. 3 and 4. This embodiment provides the secure attachment means possible with the Y-shaped end design, but has the additional advantage of being widely adjustable in length. Adjustability is accomplished by doubling the strip 22 around an oval ring 40 attaching it to an adjustable slide clamp 42. The slide clamp 42 can be moved along the strip 22 and fastened to the strip 22 at any desired length. In this manner, regardless of the size of the item being bound, the strip can always be positioned to assure that the ends 24 and 26 are in proper position for attachment. It should be appreciated that any other length adjustment means may be substituted for this clamp and ring apparatus without departing from the present invention.

Figure 5:
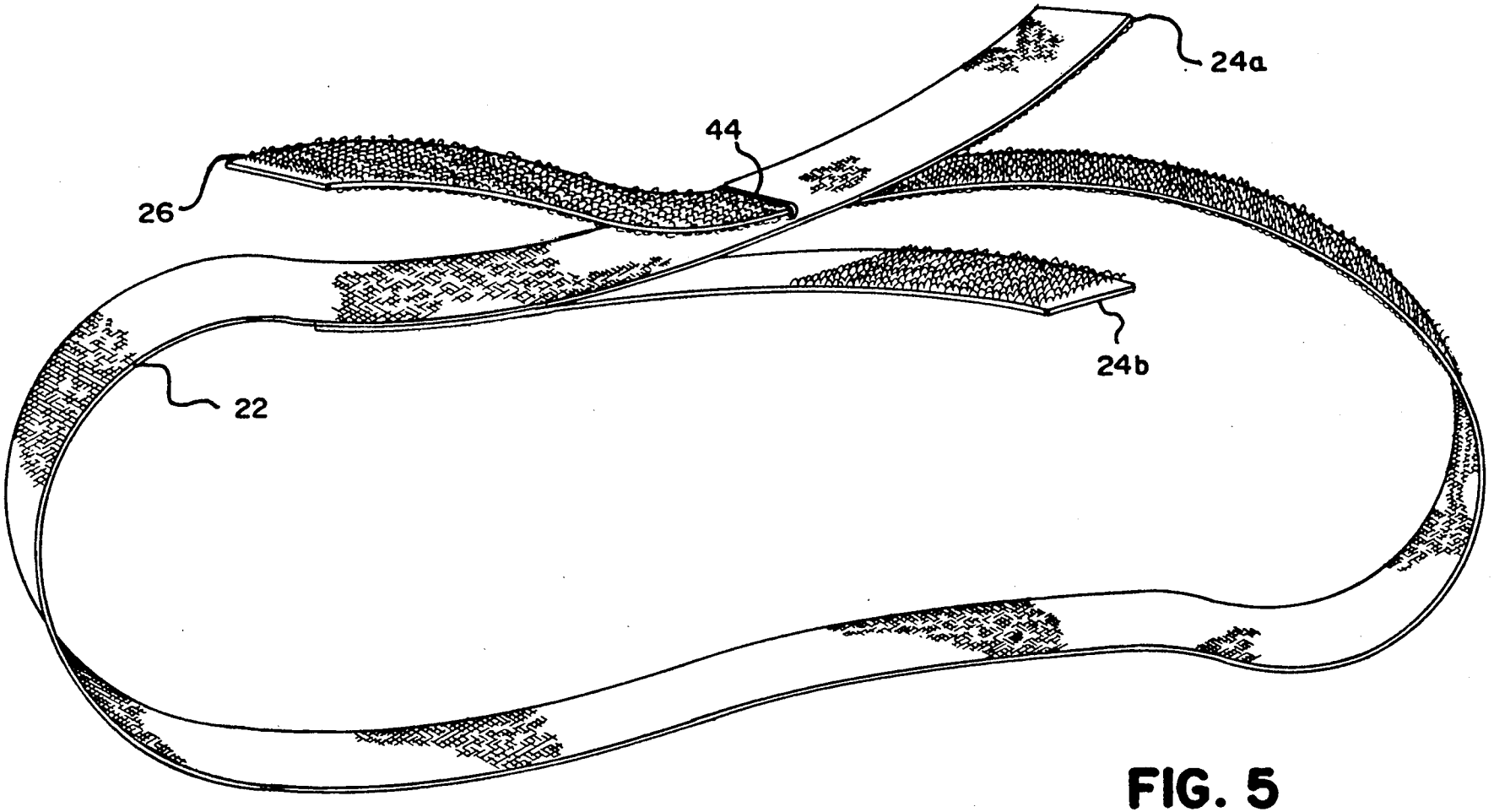
FIG. 5 is a perspective view of a fourth embodiment of the present invention, including a further means to adjust the operative length the strap.

Another means for adjusting the length of the strap 20 is shown in FIG. 5. In this embodiment, adjustability is accomplished by providing a slot 44 in the strip 22 through which end 26 may be passed. By providing hook-and-loop material along an extended length of the strip 22 extending from end 26, a secure attachment may be achieved with a wide range of adjustability—ends 24*a* and 24*b* being closed around end 26 at whatever length is desired. As is shown, it is preferred that end 24 should be wider than end 26 to leave sufficient material surrounding slot 44 for adequate strength and durability.

As has been noted, the present invention has a wide variety of possible uses. One area of particular interest, particularly with regard to the adjustable embodiments of the present invention discussed above, involves employing the present invention as a clothing belt. As is shown in FIG. 6, the strap 20 of the present invention can be easily installed on a conventional pair of pants 46 or similar garment. By adjusting the belt to the correct length in one of the manners described, the attachment means of the present invention provides a very secure belt which can be easily adjusted or removed. Since the fastened strap of the present invention is relatively flat and seamless when properly installed, the present invention readily lends itself to providing a belt buckle (not shown) or other adornment along its the length to present the illusion that it is a conventional belt.

Figure 7:
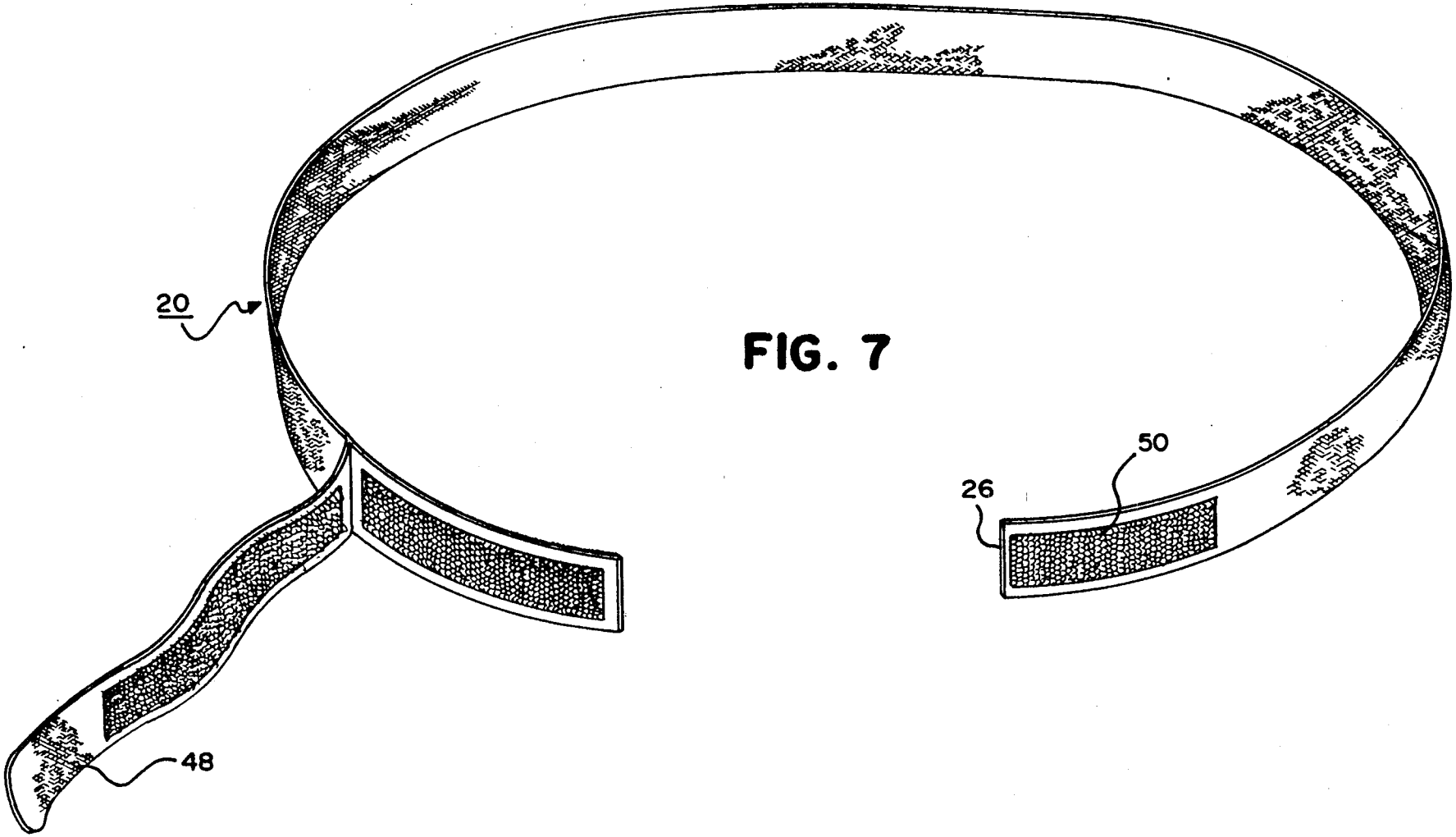
FIG. 7 is a perspective view of another embodiment of the present invention including additional strap material to assist in concealing the fastening means.

For some applications it may be desirable to help conceal the hook-and-loop fastening means of the present invention, particularly where some of the hook-and-loop material may be exposed due to one or more of the length adjustment methods employed. To this end, as is shown in FIG. 7, an additional segment of material 48 may be provided on the belt 20 which will overlap any exposed hook or loop material 50 on end 26. In an application such as a clothing belt, this extra segment of material 48 may be easily secured within a pant's or skirt's belt loop as is normally done with conventional belts.

It should be appreciated that the present invention may be used to bind any form of items together, replacing rubber bands, binder clips, string, belts, bungee cords, towing chains, guide wires, etc. Even though the length of the strap may be adjusted by the methods discussed above, the length may also be adjusted by wrapping the strip multiple times around the item to be bound in a manner similar to that commonly employed with conventional rubber bands to adjust their lengths.

Although particular embodiments of the present invention are disclosed herein, it is not intended to limit the invention to such a disclosure and changes and modifications may be incorporated and embodied within the scope of the following claims.

What is claimed is:

1. A utility band comprising:

an elongated strip of material having a first and second ends;

the second end of the band formed from two juxtaposed segments of material, the first juxtaposed segment being wider than the second juxtaposed segment, each segment including an interior face;

first and second mating portions of a hook and loop-type fastening material, said first mating portion attached to both sides of the first end of said strip, and said second mating portion is secured to the interior faces of the second end juxtaposed segments such that the second fastening material portion can enclose and fasten to both sides of the first mating portion thereby establishing a fasten length of the strip; and wherein an opening is positioned in the first juxtaposed segment of said second end at an intermediate position thereof to receive the first end of said strip passing therethrough for adjusting the fastened length of said strip.

2. The apparatus of claim 1 wherein the opening is a slot and includes a grommet reinforcement about said slot.

3. A utility band having a first and second end comprising:

an elongated strip of material;

the second end of the band comprises two joined segments of material, each segment including an interior face;

first and second mating portions of a hook and loop-type fastening material, said first mating portion attached to both sides of the first end of said strip, and said second mating portion is secured to the interior faces of the double strip end such that the second fastening material portion can enclose and fasten to both sides of the first mating portion; and means to adjust the length of the band, wherein the means to adjust the length of the band includes an opening in one of the segments of material at the second end of the band through which excess length of the first end of the band is passed to achieve correct adjustment.

4. The apparatus of claim 3 wherein the first end of the band includes an extended length of hook-and-loop material thereon to provide a greater degree of adjustability along the length of the band.

5. A belt having a first and second end and two back-to-back faces, which comprises:

an elongated strip of material;

a first portion of a hook-and-loop type fastening material attached to the first end of the strip on both of its faces;

a Y-shaped element provided at the second end of the strip, having two inwardly facing surfaces;

a second, complementary hook-and-loop fastening material attached to each of the inwardly facing surfaces so that the first end of the strip can be anchored between the two inwardly facing surfaces of the Y-shaped element; and means to adjust the length of the belt, wherein the means to adjust the length of the belt includes an opening in the Y-shaped element through which excess length of the first end of the strip is passed to achieve correct adjustment.

6. The apparatus of claim 5 wherein the first end of the strip includes an extended length of hook-and-loop material thereon to provide a greater degree of adjustability along the length of the strip.

7. A belt having a first and second end comprising:

an elongated strip of material;

the second end of the belt comprises two joined segments of material, each segment including an interior face;

fastening means comprising first and second mating portions of a hook-and-loop type fastening material, said first mating portion attached to both sides of the first end of said belt, and said second mating portion is secured to the interior faces of the double segment end such that the second fastening material portion can enclose and fasten to both sides of the first mating portion; and a slot through one of said two joined segments of material at the second end of the belt approximate to the second fastening material wherein the first end of the belt can pass therethrough for adjusting the attached length of said belt.

* * * * *